US007199528B2

(12) United States Patent
Quazi

(10) Patent No.: US 7,199,528 B2
(45) Date of Patent: Apr. 3, 2007

(54) CONTROL CIRCUIT FOR MAINTAINING CONSTANT POWER IN POWER FACTOR CORRECTED ELECTRONIC BALLASTS AND POWER SUPPLIES

(75) Inventor: Fazle S. Quazi, Boulder, CO (US)

(73) Assignee: Energy Conservation Technologies, Inc., Boulder, CO (US)

( * ) Notice: Subject to any disclaimer, the term of this patent is extended or adjusted under 35 U.S.C. 154(b) by 78 days.

(21) Appl. No.: 11/111,005

(22) Filed: Apr. 21, 2005

(65) Prior Publication Data

US 2006/0238138 A1 Oct. 26, 2006

(51) Int. Cl.
*H05B 41/16* (2006.01)
*H05B 37/02* (2006.01)

(52) U.S. Cl. ..... 315/247; 315/209 R; 315/224; 315/291; 315/307; 323/282

(58) Field of Classification Search ..... 315/209 R, 315/246, 247, 248, 291, 307, 224, 244; 323/280–282, 323/272, 205
See application file for complete search history.

(56) References Cited

U.S. PATENT DOCUMENTS 5,134,355 A * 7/1992 Hastings ..... 323/211
5,907,223 A * 5/1999 Gu et al. ..... 315/247
6,034,489 A * 3/2000 Weng ..... 315/307
6,359,395 B1 * 3/2002 Quazi et al. ..... 315/307
2003/0111968 A1 * 6/2003 Trestman ..... 315/291
2004/0183468 A1 * 9/2004 Nostwick ..... 315/247
2005/0146908 A1 * 7/2005 Feldtkeller ..... 363/125
2006/0061337 A1 * 3/2006 Kim et al. ..... 323/205
2006/0103326 A1 * 5/2006 Nostwick ..... 315/247

* cited by examiner

*Primary Examiner*—Trinh Vo Dinh
(74) *Attorney, Agent, or Firm*—Patton Boggs LLP

(57) ABSTRACT

The control circuit for maintaining constant power in power factor corrected electronic ballasts and power supplies maintains constant power in a variable load. This constant power control circuit provides a closed loop constant power management process for gas discharge lamps by adding a scaled lamp voltage to a scaled voltage that is equivalent to the measured lamp current. This sum is then fed to a comparator for comparison with a fixed reference voltage. If there is a difference between the sum and the reference voltage, the comparator sends this information to an error amplifier of the gas discharger lamp power control circuit for corrective measures and closed loop control of gas discharge lamp power. Since the sum always must attain the same value as determined by reference voltage, when the lamp voltage increases from its nominal or initial value, the lamp current is decreased by a corresponding ratio to maintain a constant power in the gas discharge lamp.

22 Claims, 5 Drawing Sheets

CONTROL CIRCUIT FOR MAINTAINING CONSTANT POWER IN POWER FACTOR CORRECTED ELECTRONIC BALLASTS AND POWER SUPPLIES

FIELD OF THE INVENTION

This invention relates to a control circuit that maintains a constant load power in a variable load by dynamically generating a current correction control signal for use in active power factor corrected electronic ballasts and power supplies.

PROBLEM

It is a problem in the field of electronic power supplies and gas discharge lamp ballasts to produce an inexpensive and simple control circuit that both provides all control functions, including active power factor corrections, and maintains a constant power in a variable load. The typical architecture of an electronic gas discharge lamp circuit is such that a high frequency alternating current is used to power the circuit. The low frequency 50/60 Hz input alternating power source is first converted into a DC power by a full wave rectifier. This DC power is then converted into a high frequency alternating power source, usually higher than 20 kHz, to provide power to the gas discharge lamp.

In order to reduce the variations in the DC voltage after full wave rectification, a large smoothing capacitor is often used. The current drawn by the large smoothing capacitor causes harmonic distortions in the input AC line at times when the smoothing capacitor is rapidly charging. The charging time of the smoothing capacitor is very small if a large smoothing capacitor is used and all the required charge is loaded into the smoothing capacitor in a short period of time. This rapid charging of the smoothing capacitor at the peaks of the AC sinusoid waveform is the cause for harmonic distortions and low power factor.

A control circuit that controls the operation of the gas discharge lamp operation may be used for active power factor corrections. Some of the gas discharge lamp control circuits provide a method for active power factor correction, but in doing so generate a significant amount of Electro Magnetic Interference (EMI) and feeds this interference back to the input power line. The Electro Magnetic Interference is due to the use of part of the resonant circuit energy for active power corrections. By adding a large inductor to this control circuit, the interference problem can be limited, but this adds significant additional cost, weight, and space. Thus, this solution is not cost effective, in particular, given the cost sensitivity of gas discharge lamp ballasts.

A further improvement is found in U.S. Pat. No. 6,253,243 and U.S. Pat. No. 6,359,395 which disclose a control circuit that provides an improved method for power factor correction characteristics and low Electro Magnetic noise. This new control circuit uses an Electro Magnetic Interference abatement circuit that consists of a series connected diode in one of the DC input lines from the full wave rectifier and a capacitor connected across the DC input lines from the full wave rectifier to eliminate the Electro Magnetic Interference generated by the power factor and gas lamp control circuits. This is accomplished in part by the operation of the series connected diode which blocks reverse currents, thereby preventing high frequency current present in the electronic device from flowing back to the AC input line through the full wave rectifier. In addition, the use of the capacitor across the DC input line helps to absorb high frequency current that is present on the input lines from the full wave rectifier. The cost of these two elements is small compared to the use of an inductor, yet their synergistic effect on the input lines provides a significant abatement of the Electro Magnetic Interference generated by the power factor correction and gas discharge lamp control circuits.

However, none of the existing control circuits, which control the operation of gas discharge lamps, maintain constant power in a variable load as well as provide active power factor correction.

SOLUTION

The above-described problems are solved and a technical advance achieved by the present control circuit for maintaining constant power in power factor corrected electronic ballasts and power supplies (termed "constant power control circuit" herein) that is used to maintain constant power in a variable load. The constant power control circuit provides a closed loop constant power management process for gas discharge lamps by adding a scaled lamp voltage to a scaled voltage that is equivalent to the measured lamp current. This sum is then fed to a comparator for comparison with a fixed reference voltage. If there is a difference between the sum and the reference voltage, the comparator sends this information to an error amplifier of the gas discharger lamp power control circuit for corrective measures and closed loop control of gas discharge lamp power. Since the sum always must attain the same value as determined by reference voltage, when the lamp voltage increases from its nominal or initial value, the lamp current is decreased by a corresponding ratio to maintain a constant power in the gas discharge lamp.

DETAILED DESCRIPTION OF THE DRAWINGS

Gas discharge lamps have negative resistance characteristics. Because of these physical characteristics, all gas discharge lamps are current controlled. However, even by maintaining a constant current in the lamp, lamp power cannot be controlled over the life of the lamp because the lamp voltage typically increases over the life of the lamp. This is particularly true for high-pressure sodium lamps. As a typical example, a 250-watt high-pressure sodium lamp (HPS), when new, has a nominal lamp voltage of 100V and requires the provision of a 2.5A lamp current to achieve the nominal power output. After 15,000 hours of operation, this lamp voltage can increase to over 140V. In order to ensure constant lamp power and light output, the lamp current must be decreased accordingly. That is, the initial 2.5A lamp current must be reduced to 1.785A to maintain constant power, where power is the product of the lamp voltage and current applied to the gas discharge lamp.

Prior Art Regulated Power Source

Figure 2:
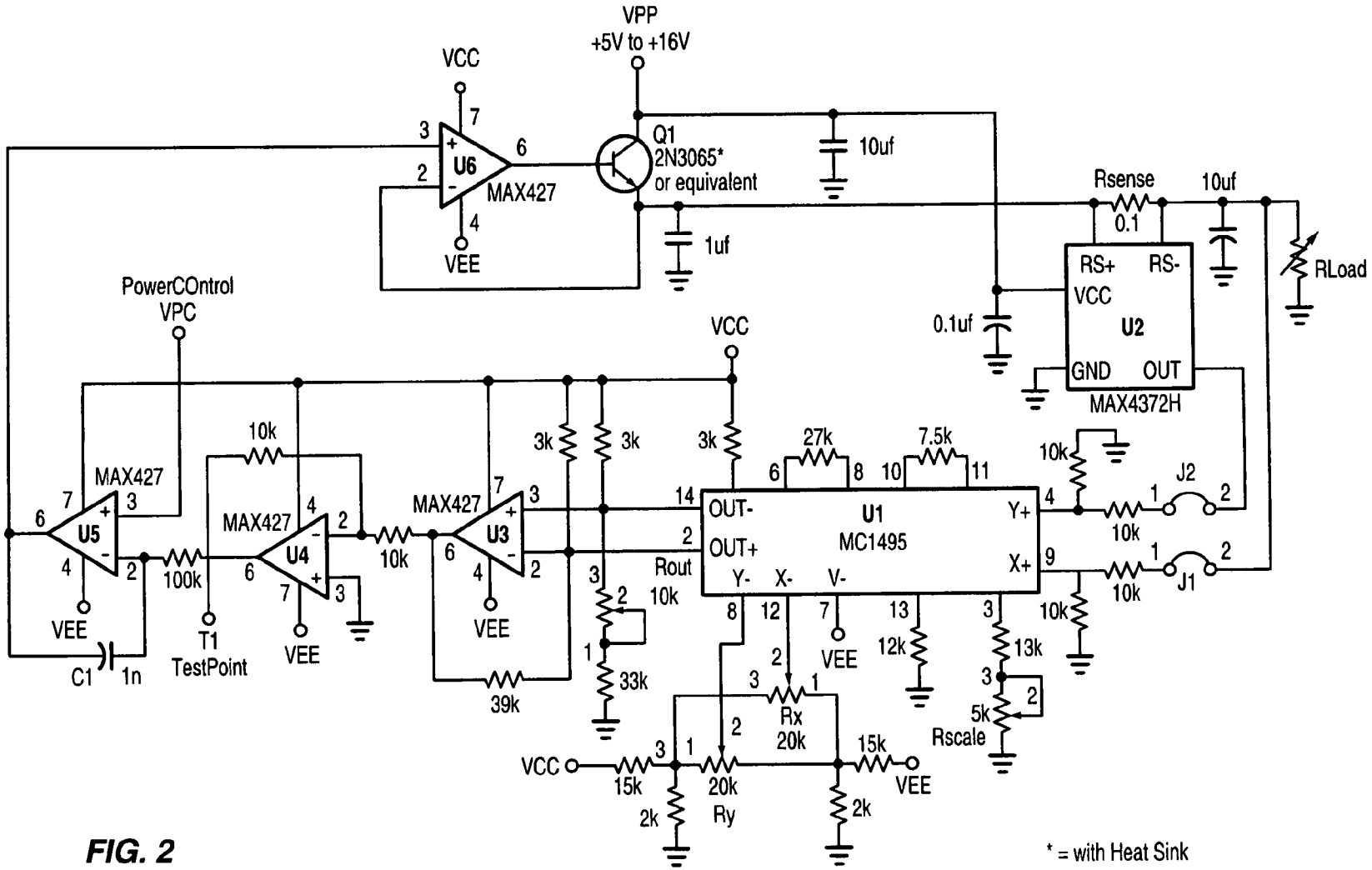
FIG. 2 PRIOR ART
FIG. 2 illustrates a typical example of a regulated power source circuit.

FIG. 2 illustrates a typical example of a regulated power source circuit, manufactured by Dallas Semiconductor, which is used to maintain constant power in a variable load, such as industrial heating, cooling, and lighting applications. Commercial multiplier ICs are expensive and, as can be seen from FIG. 2, this prior art control circuitry combines a current-sense amplifier, a number of operational amplifiers and a four-quadrant analog voltage multiplier to create a circuit that is capable of delivering an adjustable, fixed power to a variable load. The number of multiplier ICs used in this design results in an expensive regulated power source circuit, which is not practical for routine lighting applications that employ gas discharge lamps. This circuit is not only complex but often requires circuit adjustments to minimize errors and is, therefore, impractical for routine lighting applications that employ gas discharge lamps.

Prior Art Gas Discharge Lamp Control Circuits

Figure 3:
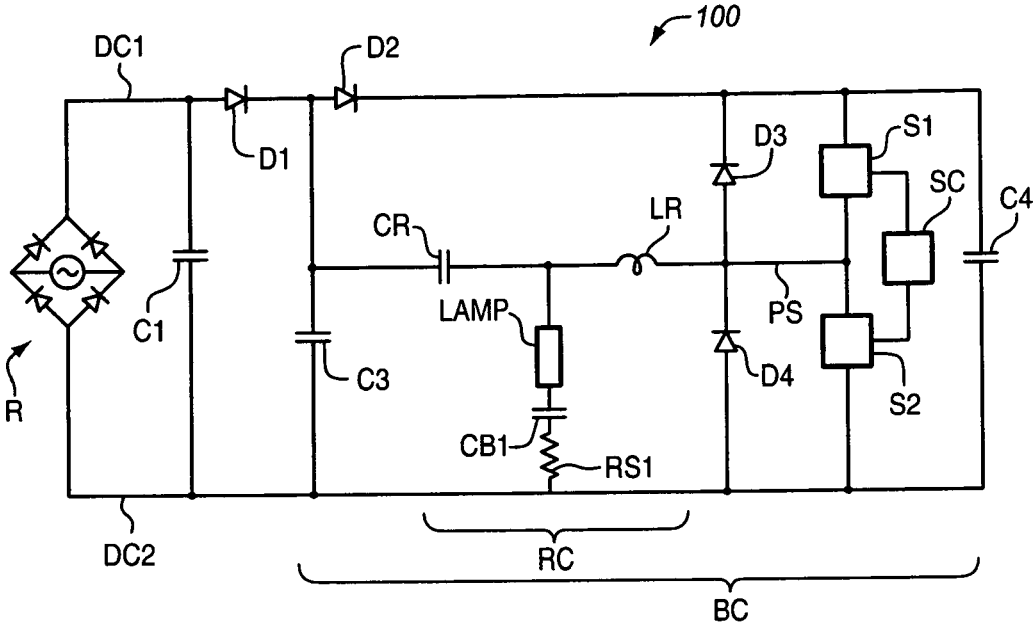
FIG. 3 PRIOR ART
FIG. 3 illustrates a prior art power factor corrected gas discharge lamp control circuit.
Figure 4:
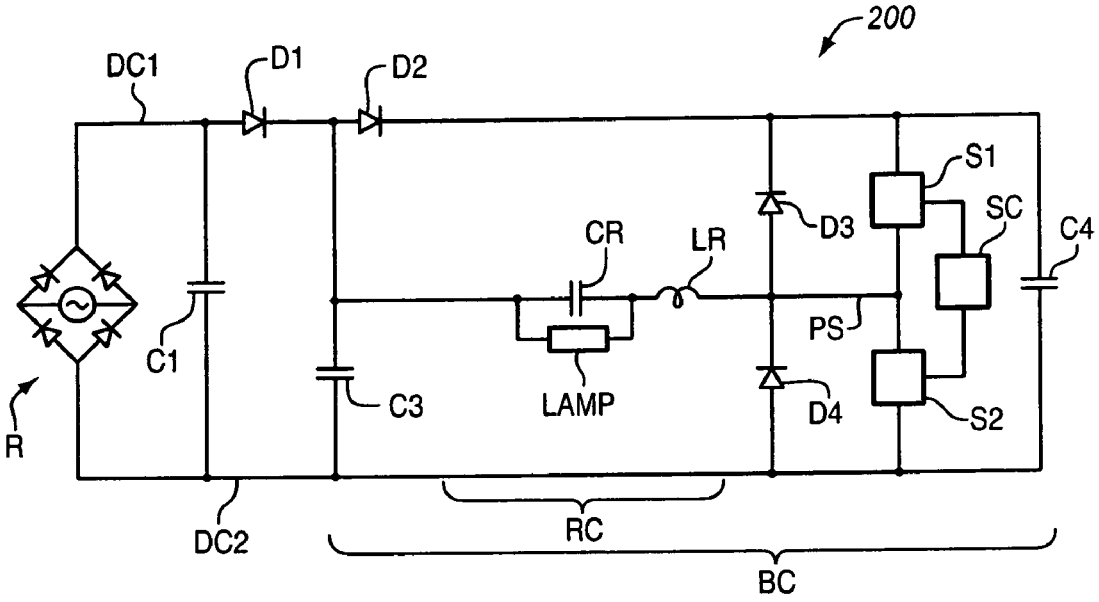
FIG. 4 PRIOR ART
FIG. 4 illustrates a prior art power factor corrected gas discharge lamp control circuit.
Figure 5:
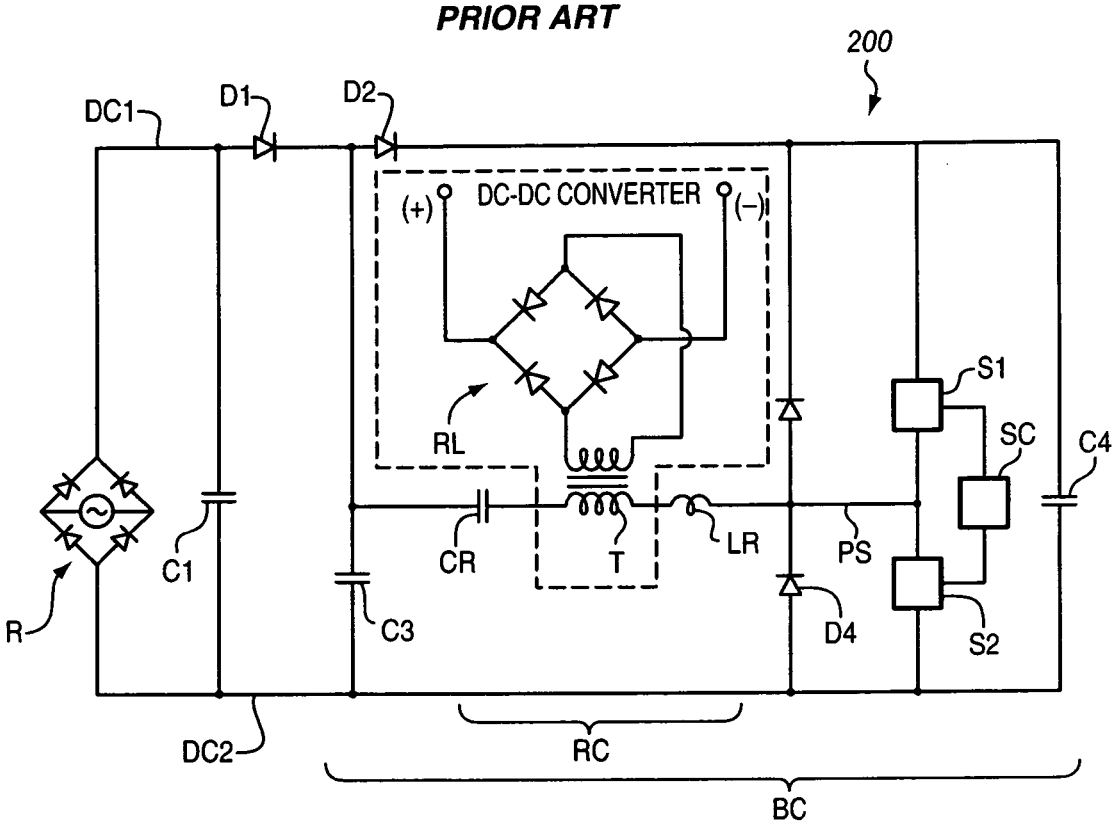
FIG. 5 PRIOR ART
FIG. 5 illustrates a prior art power factor corrected DC to DC power supply control circuit.

FIGS. 3, 4, and 5 illustrate prior art gas discharge lamp control and DC to DC power supply circuits that are disclosed in U.S. Pat. No. 6,359,395 B1 and which incorporate active power factor correction. It is the goal of the gas discharge lamp control circuit 100 to obtain a high power factor by utilizing part of resonant tank circuit energy. It is also the goal of this gas discharge lamp control circuit 100 to prevent high frequency components flowing back into the input AC line without adding a bulky and expensive inductor. As shown in FIG. 3, a source of AC voltage is used to power the gas discharge lamp circuit. The AC voltage is converted by bridge rectifier R into a Direct Current (DC) voltage that is applied to a pair of DC input lines DC1, DC2, with DC input line DC1 carrying a positive polarity and DC input line DC2 carrying a negative voltage. A basic control circuit BC is connected across the pair of DC input lines DC1, DC2. This basic control circuit BC includes smoothing capacitor C4 connected across the pair of DC input lines DC1, DC2 and provides a smoothing function, removing voltage fluctuations from the DC voltage appearing on the pair of DC input lines DC1, DC2. Conventional high frequency switching devices S1, S2 provide a high frequency alternating current to an output line PS, which is used to power the load connected thereto. The high frequency switching devices S1, S2 are controlled by a conventional switching control circuit SC that generates the gating signals used to drive the switching devices S1, S2. Clamping diodes D3, D4 are connected across switching devices S1, S2.

Power Factor Correction Using Resonant Circuit Energy

The basic control circuit BC of the gas discharge lamp control circuit 100 accomplishes the active power factor correction as well as prevents high frequency current flowing back into the input AC line. The resonant capacitor CR is connected between the resonant inductor LR and the junction of the diodes D1 and D2. Due to the orientation of the diode D2, only the positive part of the resonant voltage that develops at the junction of the resonant capacitor CR can reach the filter capacitor C4. The diode D1 prevents high frequency current flowing back into the input AC line. The function of capacitor C1 is to further suppress high frequency components. Through experiments it was found that, for achieving unity power factor, the value of the capacitor C3 was required to be almost equal to the value of the resonant capacitor CR.

Under a no load condition, the resonant voltage that develops across the capacitor C3 can be much higher than the input peak AC voltage. The higher voltage, in turn, raises the voltage across the smoothing capacitor C4 to a higher level than the input peak AC voltage. Voltage rise can be limited by means of pulse width modulation technique or by increasing the inverter operating frequency above the resonance frequency. These can be achieved by taking advantage of the programming and feedback capabilities of switch mode control circuit SC. Only one control circuit SC is needed for performing most of these functions. In fact, since inverter load regulations are usually accomplished by means of either pulse width modulation or frequency variation techniques, the same may be used for light intensity control, that is, dimming of a gas discharge lamp.

The voltage that appears across capacitor C1 is composed of rectified sinusoids. This voltage source acts as a variable clamping source for the high frequency commutating voltage that develops at the junction of the capacitors CR and C3. Ordinarily, if an external DC source is applied across the filter capacitor C4, the voltage that appears across the capacitor C3 is clamped to approximately equal to the magnitude of the applied DC voltage. However, because the input AC voltage that appears across capacitor C1 is rectified sinusoids, clamping magnitudes follow the sinusoid voltage excursions. In other words, at the instant when the sinusoid voltage is at its minimum, the voltage that appears across the capacitor C3 is approximately equal to the DC voltage level that appears across the filter capacitor C4. Whereas, at the instant when the sinusoid voltage is at its peak, the voltage across the capacitor C3 is approximately equal to the DC voltage across the filter capacitor C4 minus the input sinusoid peak voltage. Further, these sinusoidal voltage excursions happen at the rate of input AC line frequency. Therefore, current drawn from the power line is sinusoidal and synchronous to the line frequency. In ideal situations, the phase difference between current and voltage drawn is zero. As stated earlier, these are the conditions for obtaining high power factor and low harmonic distortions. By properly selecting component values under a given load condition, the method of this invention can yield a power factor of 0.99 and total harmonic distortions of less than 10%.

The method of obtaining high power factor and low harmonic distortions is indeed a simple approach but very beneficial because the same resonant tank circuit that feeds a load can also be used for active power factor corrections. Therefore, power conversion efficiency remains high and board spacing increase is no longer required. Furthermore, by placing one additional diode between the AC rectifier and the trapped resonant circuit energy, this invention also prevents high frequency current from flowing back into the input AC line.

Operation of the Basic Components of the Control Circuit

The basic control circuit BC of the gas discharge control circuit operates in well known fashion to convert the DC voltage produced by full wave rectifier R into drive signals that are applied to output lead PS to drive a gas discharge lamp to produce the illumination from the gas discharge lamp. The gas discharge lamp load can also be replaced by a high frequency transformer for providing isolated power to a gas discharge lamp or to the rectifier of a DC power supply. The following description generally characterizes the operation of the resonant circuit load that is connected to the output lead PS. The operation of the basic control circuit BC is described in a plurality of operational cycles, which occur seriatim and are then repeated as the current is applied in pulses to the gas discharge lamp.

Switch S1 turns on for a period that is approximately equal to the half of the resonant inverter operating frequency. Switch S2 also turns on for a similar period.

However, switches S1 and S2 do not turn on at the same time. While S1 is on, S2 remains in the off state and vice versa. Further, in order to avoid any cross conduction between these two switches, there exists a preset dead time when neither of the switches is in an on state. During the positive half of the input waveform when S1 is turned on by the switching control circuit SC, a single current path exists from the positive voltage carried on DC input line DC1 through the resonant circuit load RC. When S1 turns off and before S2 turns on, the current in the inductor LR reverses to negative polarity, which, in turn, creates fly-back inductor voltage. The diode D4 clamps this fly-back voltage to a potential equal to the potential of DC2. During the negative half of the input waveform when switching device S2 turns on, the negative energy into the inductor LR is returned to the rectifier R via negative voltage DC input line DC2. When the switch S2 is turned off and before switch S1 turns on, the current in the inductor LR reverses to positive polarity. The diode D3 clamps inductor fly-back voltage to a potential that is equal to the smoothing capacitor C4 voltage.

When switching control circuit SC turns on switching device S1, it establishes a discharge path from smoothing capacitor C4 through the switching device S1 through resonant circuit load RC to charge control capacitor C3 and thence along the negative voltage DC input line DC2 to return to the smoothing capacitor C4. During this time, the charging of the control capacitor C3 in series with the resonant circuit load RC causes the resonant circuit load RC voltage to increase and, as soon as the voltage across the resonant circuit load RC is higher than that across control capacitor C3 plus the diode drop of diode D2, the control capacitor C3 discharges through diode D2, switching device S1 and the resonant circuit load RC to return to itself. During the negative half of the cycle when S2 is on, a negative voltage is developed across the control capacitor C3. As described earlier, this negative voltage gets clamped by the input sinusoid that appears across the capacitor C1.

Figure 1:
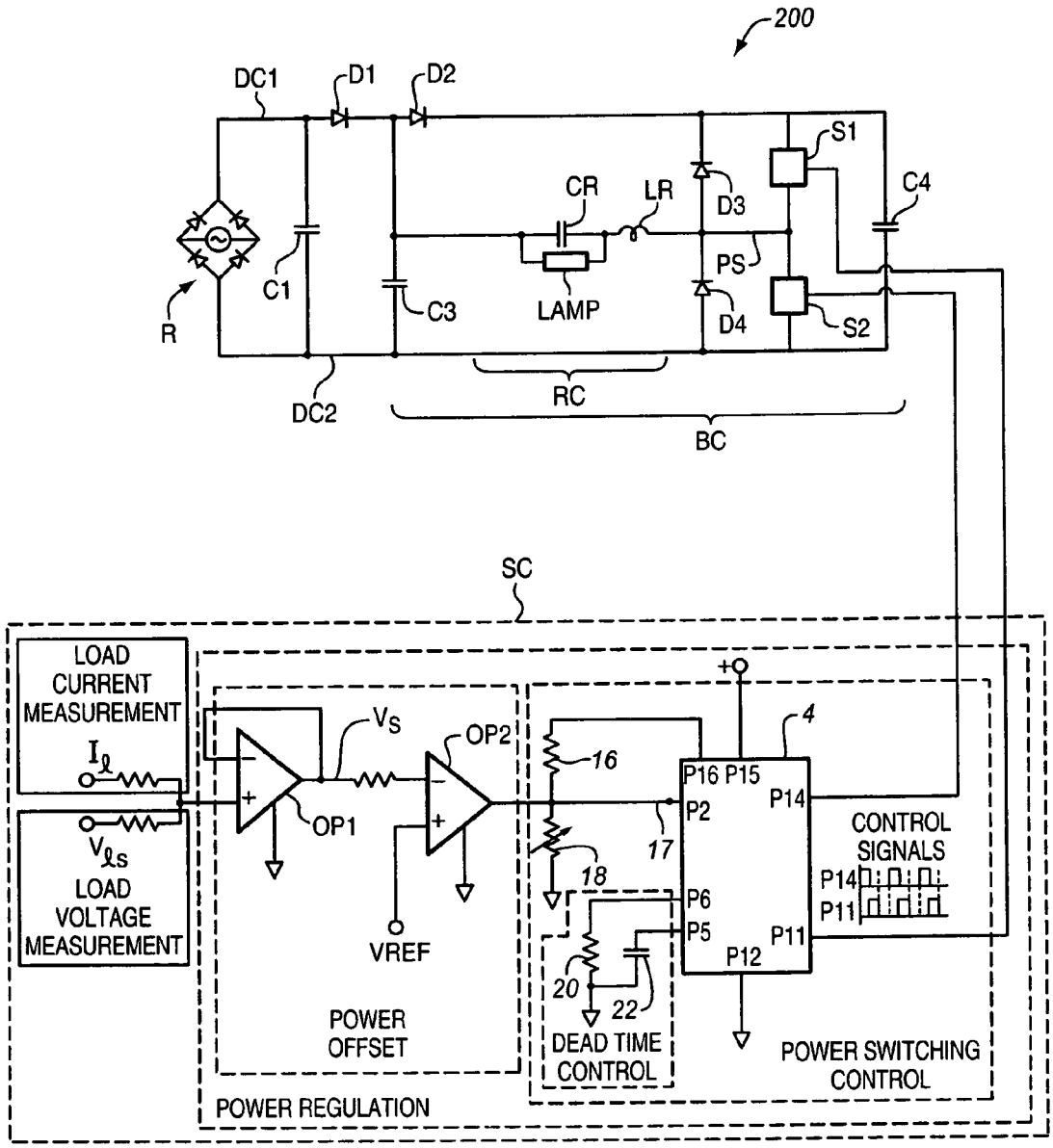
FIG. 1 illustrates the present constant power control circuit.

This cycle repeats as the switching control circuit SC turns on and off the switching devices S1 and S2 as described above. This operation of the basic components of the gas discharge lamp control circuit is conventional. However, as noted above, the channeling part of the energy from the lamp resonant circuit for the purpose of active power factor corrections results in the generation of a significant amount of Electro Magnetic Interference. The addition of various Electro Magnetic Interference abatement circuitries to the circuit described above significantly improves performance without incurring a significant incremental cost over the basic circuit described above. In addition, the reconfiguration of the resonant circuit load RC as shown in FIG. 1 produces improved performance.

The output line PS drives a series-parallel resonant circuit RC comprising an inductor LR and capacitor CR in series in a first leg of the resonant circuit RC and, with a gas discharge lamp, capacitor CB1 and resistor RS1 in series in a second leg of the resonant circuit. The first leg of this series-parallel resonant circuit RC is connected to the positive DC1 and negative DC2 input lines. The second leg of the series-parallel resonant circuit RC is connected directly to the negative polarity DC input line DC2. This control circuit uses an Electro Magnetic Interference abatement circuit that consists of a series connected diode D1 in one of the DC input lines from the full wave rectifier R and a capacitor C1 connected across the DC input lines DC1, DC2 from the full wave rectifier R to eliminate the Electro Magnetic Interference generated by the gas discharge lamp circuit, which consists of the gas discharge lamp and its associated control circuit. This is accomplished in part by the operation of the series connected diode D1 which blocks reverse currents, thereby preventing high frequency current present in the gas discharge control circuit from flowing back to the AC input line through the full wave rectifier R. In addition, the use of the capacitor C1 across the DC input line DC1, DC2 helps to absorb high frequency current that is present on the input lines DC1, DC2 from the full wave rectifier R. The cost and size of these two elements are small compared to the use of an inductor, yet their synergistic effect on the DC input lines DC1, DC2 provides a significant abatement of the Electro Magnetic Interference generated by the gas discharge lamp and its associated control circuit.

The series-parallel resonant circuit RC is returned to the negative side of the DC input line DC2 via a blocking capacitor CB1 and current sense resistor RS1. The current sense resistor RS1 serves to sense the total lamp current. The circulating current that flows into the resonant capacitor CR does not flow into the series-parallel resonant circuit RC. Total lamp current sensing is important for proper lamp starting, lamp operating, and end of lamp life detection.

In the gas discharge lamp control circuit 200, as shown in FIG. 4, the output line PS drives a series resonant circuit RC comprising an inductor LR connected in series with a parallel connected capacitor CR and gas discharge lamp. This series resonant circuit RC is connected to the positive DC1 and negative DC2 input lines. This control circuit uses an Electro Magnetic Interference abatement circuit that consists of a series connected diode D1 in one of the DC input lines from the full wave rectifier R and a capacitor C1 connected across the DC input lines DC1, DC2 from the full wave rectifier R to eliminate the Electro Magnetic Interference generated by the gas discharge lamp circuit, which consists of the gas discharge lamp and its associated control circuit. This is accomplished in part by the operation of the series connected diode D1 which blocks reverse currents, thereby preventing high frequency current present in the gas discharge control circuit from flowing back to the AC input line through the full wave rectifier R. In addition, the use of the capacitor C1 across the DC input line DC1, DC2 helps to absorb high frequency current that is present on the input lines DC1, DC2 from the full wave rectifier R. The cost and size of these two elements are small compared to the use of an inductor, yet their synergistic effect on the DC input lines DC1, DC2 provides a significant abatement of the Electro Magnetic Interference generated by the gas discharge lamp and its associated control circuit.

FIG. 5 shows an isolated power supply to produce a DC voltage, using a control circuit as shown in FIG. 4. In this application, the voltage that develops across the secondary of the transformer T is used to supply a full wave bridge rectifier RL that converts the secondary voltage of the transformer T into a DC voltage.

Constant Power Control Circuit

The present constant power control circuit maintains a constant power in the gas discharge lamp powered by the gas discharge lamp control circuit of FIG. 3 by providing an improved control circuit SC to maintain constant power in a variable load. The constant power control circuit SC provides a closed loop constant power management process for gas discharge lamps by adding a scaled lamp voltage to a scaled voltage that is equivalent to the measured lamp current. This sum is then fed to a comparator for comparison with a fixed reference voltage. If there is a difference between the sum and the reference voltage, the comparator sends this information to an error amplifier of the gas discharger lamp power control circuit for corrective measures and closed loop control of gas discharge lamp power. Since the sum always must attain the same value as determined by reference voltage, when the lamp voltage increases from its nominal or initial value, the lamp current is decreased by a corresponding ratio.

As shown in FIG. 1, amplifier OP1 sums the scaled lamp voltage $V_{ls}$ and lamp current $I_l$ to produce a voltage termed the monitoring sum $V_s$. Comparator OP2 compares the monitoring sum $V_s$ with a reference voltage $V_{REF}$. If there is a difference between the monitoring sum $V_s$ and the reference voltage $V_{REF}$, the comparator OP2 sends this information to multiplier 4, which maintains the constant power in the lamp at the measured higher or lower line voltages by varying the duty cycles of the output pulses accordingly as shown in FIG. 1. Depending on the monitoring sum $V_s$, the comparator OP2 varies the voltage applied to the non-inverted input of the error amplifier of the multiplier 4. Any variation at this non-inverted input causes the multiplier 4 to vary duty cycles that appear at outputs P11 and P14, which, in turn, drive switching devices S1 and S2. The duty cycle variations are in proportion to maintain a constant sum of scaled lamp voltage and lamp current $I_l$. Therefore, the errors that are generated by both line and lamp voltage ($V_l$) variations can be compensated by this constant power control circuit SC, since the monitoring sum $V_s$ always must attain the same value as determined by reference voltage $V_{REF}$, when the lamp voltage ($V_l$) increases from its nominal or initial value and the lamp current $I_l$ must decrease by a corresponding ratio.

Since it is a known technique, without going into details herein, it can be stated that similar results can be obtained by varying the frequency of excitations of the resonant tank circuit. Furthermore, lamp current $I_l$ sensing can be implemented using any of the many known techniques and can be resistive means or by current transformer for no loss current sense. Sensing lamp voltage ($V_l$) is also straightforward. Proper scaling of lamp voltage is an empirical method. Lamp technical data can be used for this purpose.

ALTERNATIVE EMBODIMENTS

It must be noted that constant power control using the present constant power control circuit SC is not limited to resonant inverter based electronic ballast and DC to DC power supplies. This applies to all power inverter topology with and without power factor corrections. This also applies to electronic ballasts powered by DC. Further, this invention can also be applied to many variable loads other than gas discharge lamps. The above-noted U.S. Pat. No. 6,359,395 B1 discloses a number of gas discharge lamp control circuits, and the present constant power control circuit can be used in conjunction with these various embodiments of gas discharge lamp control circuits as well as others known in the art or alternatives thereof.

A further advantage of this constant power control circuit is that gas discharge lamps can easily be dimmed. In FIG. 1, the monitoring sum $V_s$ that is applied to the non-inverted input of comparator OP2 is such that this is equal to the sum $V_{ls}+I_l$, as explained earlier. The reduction of reference voltage $V_{REF}$ means reduction of power into the gas discharge lamp, since the current input $I_l$ into the lamp is reduced to maintain a constant power, the magnitude of which is determined by the value of reference voltage $V_{REF}$. That is to say, simply by reducing the reference voltage $V_{REF}$, the gas discharge lamp can be dimmed. Moreover, a constant lamp power at a desired dimming level can be maintained using the constant power control circuit because the feedback control loop maintains a constant gas discharge lamp power that is independent of AC line voltage variations and lamp characteristics. Lamp characteristic changes have other impacts during dimming operation. A gas discharge lamp, when dimmed and depending on the dimming level, can have a gas temperature substantially lower than nominal value. This change in gas temperature changes the lamp characteristics. For example, when a compact fluorescent lamp is dimmed down to 20% light level, even when there is no AC line voltage or circuit change, because of lower gas temperature the light gradually drops much below the 20% level. This often causes lamp extinction. The present constant power control circuit prevents this effect by maintaining constant power in the lamp.

Closed Loop Constant Power Process

The following examples explain this closed loop constant power process:

EXAMPLE 1

Given a 250 W HPS Lamp with a.) initial lamp voltage ($V_l$)=100V and
b.) initial lamp current $I_l$=2.5A, then the lamp power=250 watts
c.) scaled voltage equal to lamp current=2.5V
d.) lamp voltage scaling factor=scaled lamp voltage (initial lamp voltage=100·X·0.01)×1.8.
e.) sum=1.8V+2.5V=4.3V (comparator input).

For other lamp voltages ($V_l$):

| Actual lamp voltage ($V_l$) | Scaled lamp volt ($V_{ls}$) | % of lamp volt change | New lamp current ($V_s - V_{ls}$) = $I_l$ | Lamp power ($V_l$ * $I_l$) |
|---|---|---|---|---|
| 120 | 2.16 | 20 | 2.14 | 257 watt |
| 140 | 2.52 | 40 | 1.78 | 249 watt |
| 150 | 2.7 | 50 | 1.6 | 240 watt |

EXAMPLE 2

Given a 400 W HPS Lamp with a.) initial lamp voltage ($V_l$)=100V and
b.) initial lamp current $I_l$=4A, then the lamp power=250 watts
c.) scaled voltage equal to lamp current=4V
d.) lamp voltage scaling factor=scaled lamp voltage (initial lamp voltage=100*0.01)×3
e.) sum=3V+4V=7V (comparator input)

For other lamp voltages ($V_l$):

| Actual lamp voltage ($V_l$) | Scaled lamp volt ($V_{ls}$) | % of lamp volt change | New lamp current ($V_s - V_{ls}$) = $I_l$ | Lamp power ($V_l$ * $I_l$) |
|---|---|---|---|---|
| 120 | 3.6 | 20 | 3.4 | 408 watt |
| 140 | 4.2 | 40 | 2.8 | 392 watt |

EXAMPLE 3

Given a 70 W HPS Lamp with a.) initial lamp voltage ($V_l$)=52V and
b.) initial lamp current $I_l$=1.346A, then the lamp power=250 watts
c.) scaled voltage equal to lamp current 1.346V
d.) lamp voltage scaling factor=scaled lamp voltage (initial lamp voltage=52*0.01)×0.9
e.) sum=0.9+1.35=2.25V (comparator input)

For other lamp voltages ($V_l$):

| Actual lamp voltage ($V_l$) | Scaled lamp volt ($V_{ls}$) | % of lamp volt change | New lamp current ($V_s - V_{ls}$) = $I_l$ | Lamp power ($V_l * I_l$) |
|---|---|---|---|---|
| 62 | 1.073 | 19.2 | 1.177 | 73 watt |
| 70 | 1.21 | 34.6 | 1.038 | 72.7 watt |
| 78 | 1.35 | 50 | 0.9 | 70.2 watt |

The above examples clearly demonstrate that properly scaled lamp voltage when added to lamp current, the lamp wattage remains substantially constant for a substantial lamp voltage increase from its initial value. Further, because of the negative resistance characteristics of a gas discharge lamp, any deviation from original sum value gets further compensated. For example, in Example 1, when lamp voltage reaches 120V, the lamp power increases by +7 watts. This causes slightly higher current flow in the lamp. Since the gas discharge lamp has negative resistance characteristics, higher current flow in the gas discharge lamp then, in turn, shall cause lamp voltage to increase. The sum must also then increase. However, the control loop of FIG. 1 prevents this from happening. As a result, the lamp current shall be forced to decrease. Actual lamp voltage may be 121V rather than 120V and actual current flow may be 2.1A rather than 2.14A. Therefore, actual power in the gas discharge lamp is lower than 257 watts. Therefore, it can be concluded that lamp negative resistance characteristics positively impact the operation of the constant power control circuit.

SUMMARY

The present constant power control circuit maintains constant power in a variable load. The constant power control circuit provides a closed loop constant power management process for gas discharge lamps by adding a scaled lamp voltage to a scaled voltage that is equivalent to the measured lamp current. When the lamp voltage increases from its nominal or initial value, the lamp current is decreased by a corresponding ratio to maintain a constant power in the gas discharge lamp.

What is claimed:

1. A constant power control circuit that interconnects an output line to a load, said constant power control circuit being connected to a source of DC voltage, having first and second terminals, said constant power control circuit being powered by a DC voltage applied from said source of DC voltage across a pair of input lines, wherein said load is connected at a first end to said output line and a return path connects a second end of said load to both of said pair of input lines, the constant power control circuit comprising:

a pair of switching device means connected in series across said pair of input lines, said output line being connected to the junction of said pair of serially connected switching device means;

switching control means associated with the switching device means for switching the switching device means to conduct alternatively between positive and negative ones of said pair of input lines at a predetermined high frequency, comprising:

load voltage means for determining a voltage across said load, load current means for determining a current through said load, and power regulation means, responsive to said voltage across said load and said current through said load, for switching the switching device means to maintain a constant power in said load.

2. The constant power control circuit of claim 1 wherein said power regulation means comprises:

power offset means for generating a power offset signal comprising a difference between a load power computed from said voltage across said load and said current through said load, and a predetermined reference.

3. The constant power control circuit of claim 2 wherein said power regulation means further comprises:

power switching control means, responsive to said power offset signal, for adjusting the switching of the switching device means an amount determined by said power offset signal to conduct alternatively between positive and negative ones of said pair of input lines at a predetermined high frequency.

4. The constant power control circuit of claim 1 further comprising:

diode means having an anode terminal and a cathode terminal, said anode terminal being connected to said first terminal of said source of DC voltage and said cathode terminal being connected to a first of said pair of input lines.

5. The constant power control circuit of claim 1 wherein said load comprises:

inductive element means having first and second terminals, and being connected at said first terminal to said output line;

gas discharge lamp means connected in series between said second terminal of said inductive element means and said return path for connecting a second end of said load to both of said pair of input lines; and capacitor means connected in parallel with said gas discharge lamp means.

6. The constant power control circuit of claim 5 wherein said power regulation means further comprises:

means for maintaining a finite time between each of the switching during which both of said switching device means are m a non-conductive state.

7. The constant power control circuit of claim 6 further comprising:

a smoothing capacitor connected across said first and said second terminals of said source of DC voltage; and a path for conducting charge from said inductive element means in said load to charge said smoothing capacitor during said finite time between each of the switching during which both of the switching devices are in a non-conductive state.

8. The constant power control circuit of claim 1 wherein said load comprises:

inductive element means having first and second terminals, and being connected at said first terminal to said output line; and DC to DC converter means connected in series between said second terminal of said inductive element means and said return path for connecting a second end of said load to both of said pair of input lines.

9. The constant power control circuit of claim 8 wherein said load further comprises:

capacitor means connected in parallel with said DC to DC converter means.

10. The constant power control circuit of claim 8 wherein said power regulation means further comprises:

means for maintaining a finite time between each of the switching during which both of said switching device means are in a non-conductive state.

11. The constant power control circuit of claim 10 further comprising:

a smoothing capacitor connected across said first and said second terminals of said source of DC voltage; and a path for conducting charge from said inductive element means in said load to charge said smoothing capacitor during said finite time between each of the switching during which both of the switching devices are in a non-conductive state.

12. A constant power converter connected to a source of DC voltage, having first and second terminals, said constant power converter being powered by a DC voltage applied from said source of DC voltage across a pair of input lines, the constant power converter comprising:

a pair of switching device means connected in series across said pair of input lines, said output line being connected to the junction of said pair of serially connected switching device means;

load means connected at a first end to said output line and at a second end to both of said pair of input lines;

switching control means associated with the switching device means for switching the switching device means to conduct alternatively between positive and negative ones of said pair of input lines at a predetermined high frequency, comprising:

load voltage means for determining a voltage across said load means, load current means for determining a current through said load means, and power regulation means, responsive to said voltage across said load means and said current through said load means, for switching the switching device means to maintain a constant power in said load means.

13. The constant power converter of claim 12 wherein said power regulation means comprises:

power offset means for generating a power offset signal comprising a difference between a load power computed from said voltage across said load means and said current through said load means, and a predetermined reference.

14. The constant power converter of claim 13 wherein said power regulation means further comprises:

power switching control means, responsive to said power offset signal, for adjusting the switching of the switching device means an amount determined by said power offset signal to conduct alternatively between positive and negative ones of said pair of input lines at a predetermined high frequency.

15. The constant power converter of claim 12 further comprising:

diode means having an anode terminal and a cathode terminal, said anode terminal being connected to said first terminal of said source of DC voltage and said cathode terminal being connected to first of said pair of input lines.

16. The constant power converter of claim 1 wherein said load means comprises:

inductive element means having first and second terminals, and being connected at said first terminal to said output line;

gas discharge lamp means connected in series between said second terminal of said inductive element means and said return path for connecting a second end of said load means to both of said pair of input lines; and capacitor means connected in parallel with said gas discharge lamp means.

17. The constant power converter of claim 16 wherein said power regulation means further comprises:

means for maintaining a finite time between each of the switching during which both of said switching device means are in a non-conductive state.

18. The constant power converter of claim 17 further comprising:

a smoothing capacitor connected across said first and said second terminals of said source of DC voltage; and a path for conducting charge from said inductive element means in said load to charge said smoothing capacitor during said finite time between each of the switching during which both of the switching devices are in a non-conductive state.

19. The constant power converter of claim 12 wherein said load means comprises:

inductive element means having first and second terminals, and being connected at said first terminal to said output line; and DC to DC converter means connected in series between said second terminal of said inductive element means and said return path for connecting a second end of said load to both of said pair of input lines.

20. The constant power converter of claim 19 wherein said load means further comprises:

capacitor means connected in parallel with said DC to DC converter means.

21. The constant power converter of claim 19 wherein said power regulation means further comprises:

means for maintaining a finite time between each of the switching during which both of said switching device means are in a non-conductive state.

22. The constant power convener of claim 21 further comprising:

a smoothing capacitor connected across said first and said second terminals of said source of DC voltage; and a path for conducting charge from said inductive element means in said load to charge said smoothing capacitor during said finite time between each of the switching during which both of the switching devices are in a non-conductive state.

* * * * *